United States Patent [19]

Ogawa

[11] 4,152,867

[45] May 8, 1979

[54] CONTROLLED TOY VEHICLE ASSEMBLY

[75] Inventor: Iwakichi Ogawa, Kashiwa, Japan

[73] Assignee: Takara Co., Ltd., Tokyo, Japan

[21] Appl. No.: 870,940

[22] Filed: Jan. 20, 1978

[51] Int. Cl.[2] ..... A63H 17/36

[52] U.S. Cl. ..... 46/259; 46/213; 46/206

[58] Field of Search ..... 46/259, 252, 213, 230, 46/251, 257, 258, 260, 262, 206, 211

[56] References Cited

U.S. PATENT DOCUMENTS

| | | | |
|---|---|---|---|
| 3,083,503 | 4/1963 | Zalkind | 46/259 |
| 3,188,770 | 6/1965 | Nyc | 46/262 |
| 3,252,248 | 5/1966 | Zalkind | 46/259 |
| 3,303,607 | 2/1967 | Zalkind | 46/259 |
| 3,327,796 | 6/1967 | Hanmer | 46/259 X |
| 3,570,180 | 3/1971 | Oda | 46/259 |
| 3,596,401 | 8/1971 | Camire | 46/259 |
| 3,597,876 | 8/1971 | Haji | 46/257 X |

*Primary Examiner*—Louis G. Mancene

*Assistant Examiner*—Mickey Yu

*Attorney, Agent, or Firm*—Harold L. Jackson; Stanley R. Jones; Joseph W. Price

[57] ABSTRACT

A toy vehicle assembly capable of controlled locomotion in response to variations in frictional resistance along a support surface and method is provided. The support surface is a relatively low frictional surface such as a flexible sheet of polyethylene. A subjectively determined higher frictional guide pattern can be placed on the surface such as by a wax marker. The toy vehicle has a pair of driving front wheels and a power rear wheel. The axis of rotation for each of the wheels are non-parallel to the other axes. A coefficient of friction of the power rear wheel is greater than that of the front control wheels. The driving power wheel can propel the vehicle while the front control wheels can respond to variations in the frictional resistance of the support surface to control the direction of the toy vehicle. The frictional path can be subjectively varied and is preferably made from a water soluble material that can be removed from the support surface.

31 Claims, 8 Drawing Figures

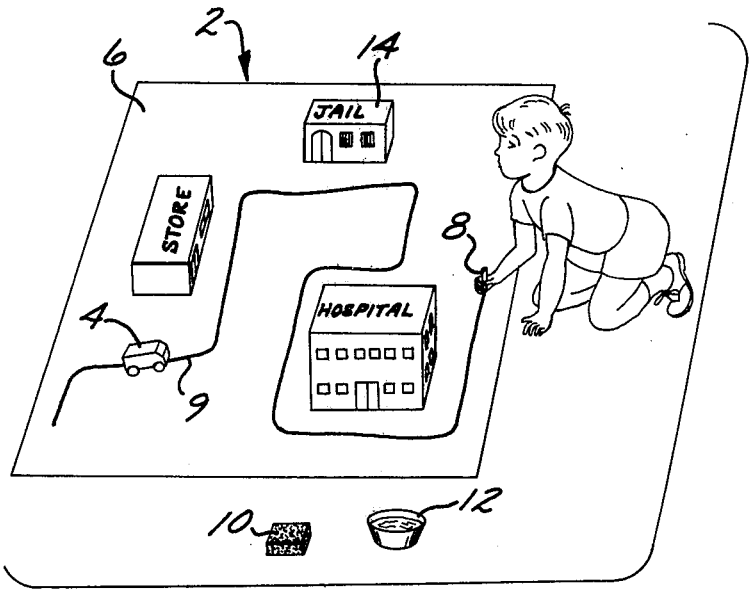
FIG. 1
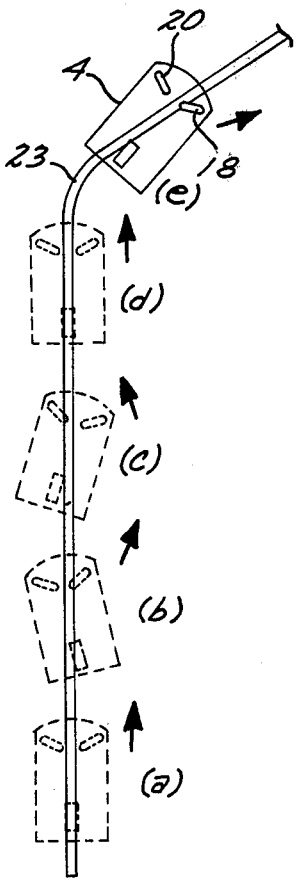
FIG. 4
FIG. 2
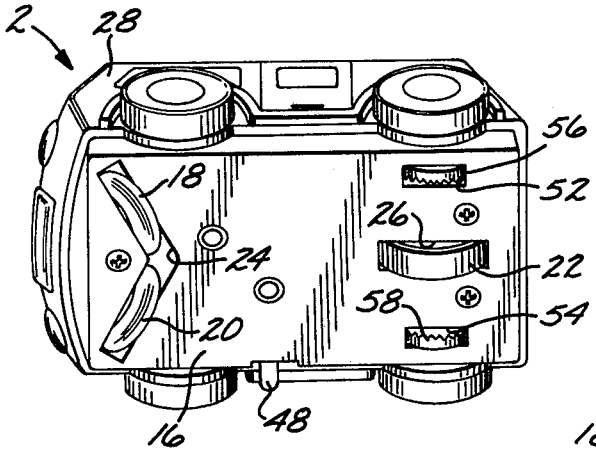
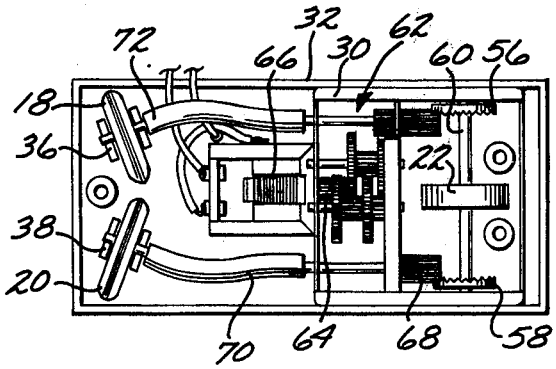
FIG. 6
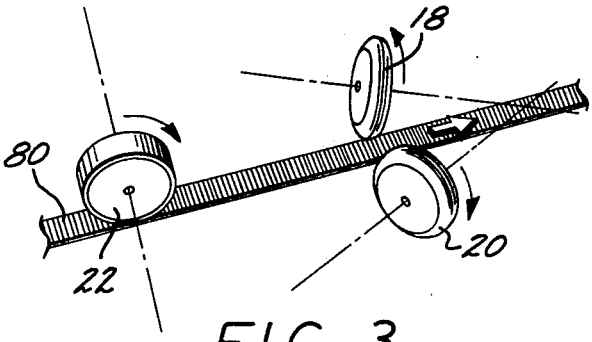
FIG. 3

CONTROLLED TOY VEHICLE ASSEMBLY

BACKGROUND OF THE INVENTION

1. Field of the Invention

The present invention is directed to a toy vehicle assembly and more particularly to a toy vehicle that is responsive to variations in frictional resistance along a support surface and a method of subjectively providing a removable frictional guide pattern.

2. Description of the Prior Art

The toy industry is quite familiar with various forms of controlling the direction of a self-propelled toy vehicle.

One type of toy found in the prior art takes the form of a tractor which is designed to reverse its motion upon contacting an obstacle. Different variations of this toy vehicle are known to provide a toy that will randomly respond to various obstacles in a non-controlled manner such as the Canadian Patent No. 960,860.

Another series of toys includes a road race set with various subjectively controlled racing cars. Generally, the individual cars are controlled by tracks in the form of either slots or electrical conduits embedded in or on the surface of the track. The track is sold either as a unitary playing surface or with individual track segments. While a limited degree of subjective layout of the track is possible, by varying the arrangement of the individual track segments, these variations are extremely limited. The following U.S. patents are cited of general interest, U.S. Pat. No. 3,837,286; U.S. Pat. No. 3,797,404 and U.S. Pat. No. 3,205,618.

A final form of controlled toy is known in the prior art wherein radio signals can be picked up by a receiver in the car and solenoids can vary the position of the wheels in response to the signals. Alternatively, a wire can be directly connected to the car to transmit the control signals either electronically or through a flexible mechanical cable.

The prior art is still seeking a relatively economical toy vehicle that can be controlled during its locomotion in a manner that will heighten the child's enjoyment of the game and provide a maximum amount of subjective control.

SUMMARY OF THE INVENTION

A toy vehicle game assembly is provided that is capable of controlled locomotion in response to variations in frictional resistance along a support surface. The support surface can be provided as part of a game assembly in the form of a flexible plastic sheet. A subjectively determined frictional path can be marked onto the surface for example by a hand held marker. The toy vehicle can have a base member with a longitudinal axis for rotatively supporting a first power wheel. The axis of rotation of the first power wheel is generally traverse to the longitudinal axis. A second pair of wheels can be operatively connected to the base member to rotate respectively about a second and third axis that are each non-parallel to the first axis and also to each other. The relative coefficient of friction of the front wheels with the support surface differs from that of the rear power wheel. Specific coefficients of friction are relative to the support surface and marker that are utilized. The important feature is that the coefficients of friction of the front wheels will readily permit the wheels to slip across the support surface but will drive the toy vehicle when contacting the indicia guide pattern on the support surface. The coefficient of friction of the driving wheel is such that it will drive the vehicle with a force along the longitudinal axis regardless of contact with the support surface or the indicia guide pattern.

Preferably, the indicia guide pattern can be water soluble and can be removed from the support surface to permit a repetitive use of the support surface. Alternatively, a tape guide pattern can be applied to the support surface or the support surface itself can be embossed to mechanically create a section of the surface with a higher coefficient of friction.

The method of controlling the locomotion of the toy vehicle includes providing a support surface having a coefficient of friction of such a value that the front wheels slide across the support surface when the rear wheel drives the toy vehicle. The child can then provide an indicia guide pattern on the support surface by subjectively imprinting one or more lines with a hand held marker. The toy vehicle can then be positioned on the support surface either straddling a single guideline or positioned between two guidelines so that the front wheels can be reponsive to the guidelines that control the locomotion of the toy vehicle.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

BRIEF DESCRIPTION OF THE DRAWINGS

FIG. 1 is a perspective schematic view of the toy vehicle game assembly of the present invention;

FIG. 2 is a perspective bottom view of the toy vehicle of the present invention;

FIG. 3 is a schematic perspective view disclosing the relative rotation of the wheels of one embodiment of the toy vehicle of the present invention;

FIG. 4 is a schematic disclosing the control interaction between the toy vehicle and a single guideline;

FIG. 6 is a bottom plan view of the toy vehicle taken along the lines 6-6 of FIG. 5;

DESCRIPTION OF THE PREFERRED EMBODIMENTS

Figure 5:
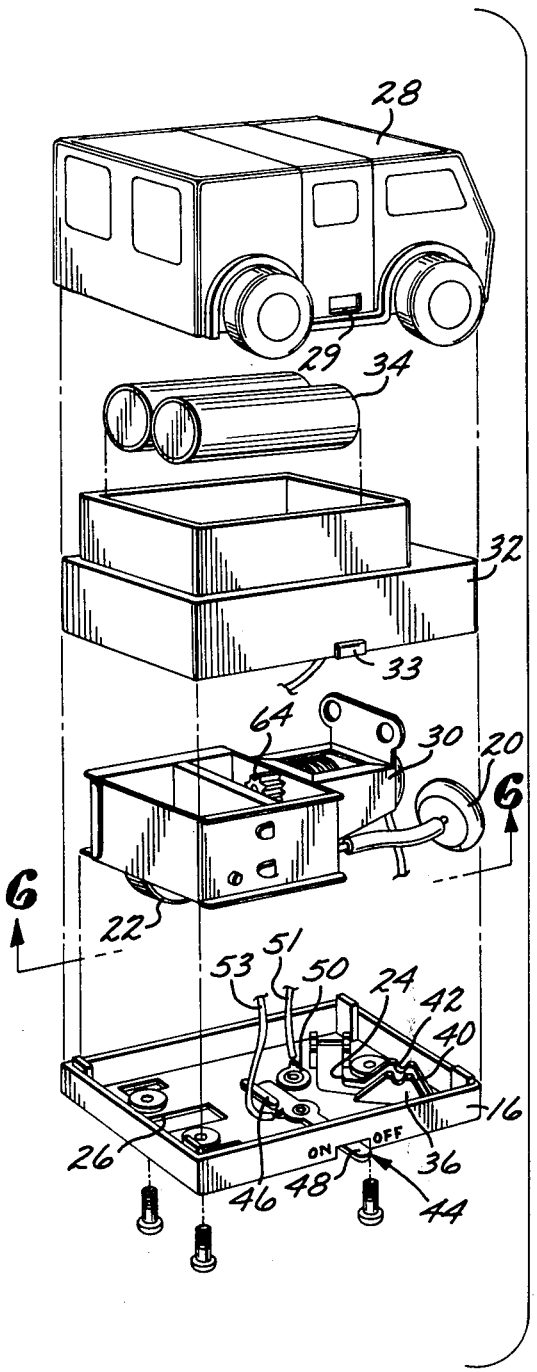
FIG. 5 is an exploded side perspective view of the toy vehicle of the present invention.

The following description is provided to enable any person skilled in the toy industry to make and use the invention and sets forth the best modes contemplated by the inventor of carrying out his invention. Various modifications, however, will remain readily apparent to those skilled in the art, since the generic principals of the present invention have been defined herein specifically to provide a relatively economical and easily mass manufactured controlled toy vehicle assembly.

Referring to FIG. 1, the controlled toy vehicle assembly 2, includes a toy vehicle 4, positioned on a support surface 6, such as a flexible polyethylene plastic sheet of one or more layers that can be subjectively printed with decorations. An indicia guide pattern 9 of higher frictional resistance than the flexible support sheet 6 can be subjectively drawn on the surface of the support sheet by a hand held marker 8. Preferably the marker 8 can be made from a water soluble material or a parafin wax. Alternatively, a conventional crayon could be used such as a mixture of wax, high molecular weight fatty acids, and higher molecular weight fatty acid esters. This wax friction pattern can be wiped clean from a plastic support surface with a damp cloth or sponge 10 that has been moistened in a bowl 12 of water.

The toy vehicle 4 will follow the path of the friction guide pattern 9 on the support sheet 6 as shown in FIG. 1. It should be realized that other support surfaces could be utilized such as paper, wood, soft vinyl, etc. An important alternative is to provide a plastic support surface substrate with a fixed frictional path that can be either painted on the surface such as a synthetic rubber paint or embossed during the molding process of the substrate. Perforations could even be provided to create sufficient frictional resistance in a further alternative embodiment. The important requirement is providing an actual support surface of relatively low frictional resistance to a pair of control wheels and a relatively higher frictional guide pattern.

Finally, various accessory items can be included in the toy vehicle assembly such as buildings 14.

Referring to FIGS. 2 and 3, a pair of front drive members are mounted on a base member 16. These drive members can take the form of wheels such as the front wheels 18 and 20. Alternatively, a track assembly could be used (not shown). A rear drive member such as rear wheel 22 is provided to propel the vehicle. The purpose of the rear drive wheel 22 is to move the vehicle body in a forward direction at all times regardless of the frictional resistance of the support surface. Thus, a kinetic force vector of a relatively constant magnitude is always applied to the vehicle during operation by the rear wheel 22.

Referring specifically to FIG. 3, a schematic view is disclosed wherein each of the wheels are driven in a clockwise direction. As can be readily seen, the front wheels 18 and 20 are placed at an angle to the longitudinal axis of the toy vehicle or the plane containing the rear wheel 22. The axes of rotation of these respective front wheels 18 and 20 extend in a manner to diverge from the rear wheel 22.

Since the respective front wheels 18 and 20 are formed from the same material and rotate at the same rate of rotation their respective kinetic force vectors which are traverse to the direction of the rear wheel force vector will be nullified, that is they are in the opposite direction and will cancel each other out. Any other component of these force vectors in the same direction as the rear wheel force vector will, of course, contribute to the forward motion of the vehicle. The exact magnitude of the force vectors of the front wheels 18 and 20 will also be dependent upon the angle that the axes of rotation of the front wheels form with the longitudinal axis of the vehicle.

When either one of the front wheels encounters a portion of the support surface with a variance in frictional resistance from the other wheel surface contact, then the kinetic force vectors will vary and that front wheel with the highest relative frictional resistance will dominate and will contribute a resultant force vector on the direction of the vehicle that will be the vector sum of the rear wheel force vector and a traverse vector. The vehicle will then assume a direction that will be the hypotenuse of a triangular force vector diagram.

Referring to FIG. 3, the diverging axes of the front wheels 18 and 20 can be seen. In this embodiment a tape 80 has been applied to the support surface to create an indicia guide pattern of a higher frictional resistance. The tape 80 can be removable or can be permanently attached to a support surface substrate.

Referring to FIG. 4, a schematic discloses the manner in which controlled locomotion of the toy vehicle 4 is accomplished in response to variations in frictional resistance along the support surface. The guide path 23 has a relative increased frictional resistance compared to the support surface. For example, a synthetic rubber coating could be utilized for the frictional guide path 23 and the support surface can be a polyethylene sheet. The front wheels 18 and 20 can also be made from a polyethylene plastic or a thermoplastic polyamide such as Nylon. The rear wheel 22 can be made from an appropriate rubber compound.

The arrows on FIG. 4 simply disclose a schematic force vector resulting from contact of the respective wheels with the support surface and do not represent an actual scaled force vector.

As can be appreciated, the term coefficient of friction is a relative term that depends upon the material of both the surface and the object that is moving across the surface. Additionally, the coefficient of friction varies between the static value and a kinetic value. Broadly, the coefficient of friction can be a ratio of the force required to move an object over the weight of the object in its static state and the force necessary to continue movement of the object over the weight of the object in its kinetic state.

To provide an appreciation for the relative values which can be selected in the present example, Nylon and polyethylene can be used for the front wheels and the support surface. These materials will have a static coefficient of friction of between 0.15 and 0.25 when rubbed together. Natural rubber, however, will have a static coefficient of friction of between 1 and 4 and can be used for the rear wheel 22. The natural rubber of the rear wheel 22 has a much higher coefficient of friction than the front wheels 18 and 20.

Additionally, the front wheels are positioned with their axes of rotation in a nonparallel arrangement of approximately 60 degrees to that of a plane containing the rear wheel 22. Since each of the vehicle wheels are driven as will be subsequently explained and the two front wheels are driven at the same rate of rotation, they will simply slide laterally to their plane of the rotation when the vehicle is driven forward by the rear wheel 22. When the front wheels are on the support surface with a relatively low coefficient of friction, the front wheels are ineffective in driving or controlling the toy vehicle in any specific direction. In this condition, the rear wheel simply drives the vehicle forward. Referring to FIG. 4, this is the condition of the toy vehicle 2 in its initial position (a). If the vehicle drifts to the left so that the high frictional guide pattern 23 contacts the right front wheel 18, position (b) the vehicle will be driven in the direction of rotation of the front wheel 18 as shown in the third position (c) in FIG. 4. If the vehicle is driven far enough as shown in position (c), for the left front wheel 20 to contact the guide pattern 23 the vehicle will then be driven in the opposite direction. As can be appreciated, the vehicle will accordingly, track the frictional guide pattern 23 as long as the guide pattern 23 is located between the two front wheels 18 and 20. The guide pattern 23 turns as can be seen in the final position (e) and the appropriate front wheel 18 will contact the frictional guide pattern 23 to drive it in a new direction.

Referring to FIG. 5 an exploded perspective view of the toy vehicle 4 is disclosed. A housing member 28 can be subjectively configured as desired to simply form an outer shell. The simulated wheels on the housing member 28 have no affect on the movement of the vehicle and are simply a design feature. A plastic battery housing 32 supports batteries 34 and can be provided with a protuberance 33 that will snap-fit into a notch 29 on the housing member 28. A similar protuberance and notch can be provided on the other side of the housing member 28. Mounted within the lower portion battery housing 32 is a motor and transmission chassis 30. The final structural member, the base member 16, completes the toy vehicle 4.

Referring to FIGS. 2 and 6, an electrical motor 66 can be powered by batteries 34 mounted in the battery housing 32. The motor 66 includes a power pinion gear 64 that is connected to a gear train 62. The gear train 62 reduces the output of the motor 66 and is connected to a crown gear 56 mounted on the rear axle 60. The rear axle 60 carries the drive rear wheel 22. The specific choices of gears to provide a desired reduction in speed is well-known in the prior art and does not form a part of the present invention and accordingly, it is not necessary to describe each of the specific gear component parts.

An idler crown gear 58 is also mounted on the other side of the rear axle 60 and drives a pinion gear 68 which, in turn, drives a flexible cable 70 that is attached to the front wheel 20. The flexible cable can simply be a plastic tube or other form of drive cable that is available in the prior art to provide an output of rotation power at an angle to the input rotation. As can be appreciated, other mechanical arrangements could be utilized to provide power to the front wheel 20. A similar output of power is applied to the front wheel 18 through another flexible cable 72. A pair of front wheel mountings 36 and 38 respectively support the front wheels 18 and 20.

As can be seen in FIG. 2, the base member 16 is a plate having a V-shaped front wheel slot 24 and a rectangular rear wheel slot 26. Rectangular crown gear slots 52 and 54 are also provided. Referring again to FIG. 5, the front wheel mountings each include a pair of triangular supports 40 mounted on either side of the slot 24 and having a pair of notches 42 for receiving a front wheel shaft.

A switch mechanism 44 is connected by wires 51 and 53 to the batteries 34 and the motor 66. A contact pad 50 is positioned to make electrical contact with a switch lever 48 to energize the electrical circuit. A stop member 46 is mounted on the base member 16 to limit movement of the switch lever 48. Appropriate fasteners can be used to hold the base member 16 onto the battery housing 32. The gear transmission is designed to provide a ratio of front wheel to rear wheel movement of about 2.5 to 1 so that the front wheels will rotate more than twice as fast as the rear wheel.

Figure 7:
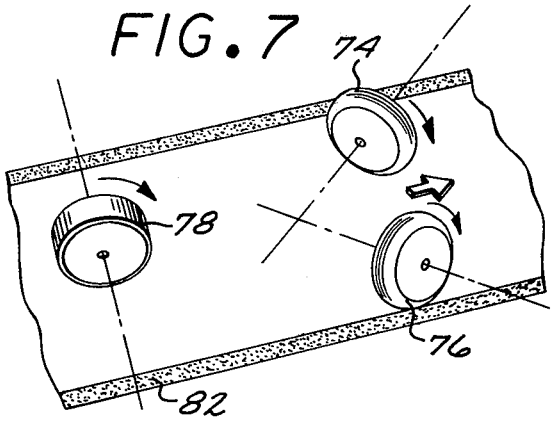
FIG. 7 is a schematic perspective view of another arrangement of the wheels of the toy vehicle of the present invention.

FIG. 7 discloses a schematic alternative embodiment of the present invention wherein the respective front wheels 74 and 76 are again positioned so that their axis of rotation are not parallel to either a rear drive wheel 78 nor to each other. The inclination of the front wheels 74 and 76 in this arrangement are designed to drive the vehicle in an opposite direction from that disclosed in the embodiment of FIGS. 3 and 4. Accordingly, the right front wheel 76 is designed to drive the vehicle to the left and the left front wheel 74 vice versa. Again, the same principal of providing a low coefficient of friction to both the support surface and the front drive wheels is utilized so that the front drive wheels are slid in a lateral direction to a plane of their rotation when they are driven across the support surface by the rear wheel 78. The pair of guide tracks 82 can actually be a portion of the support surface that has been embossed with serrations to provide a rough surface to specifically increase the frictional resistance. Accordingly, a set pair of guide paths or tracks can be molded right into the surface of the support surface, for example, in a vacuum molding technique.

Figure 8:
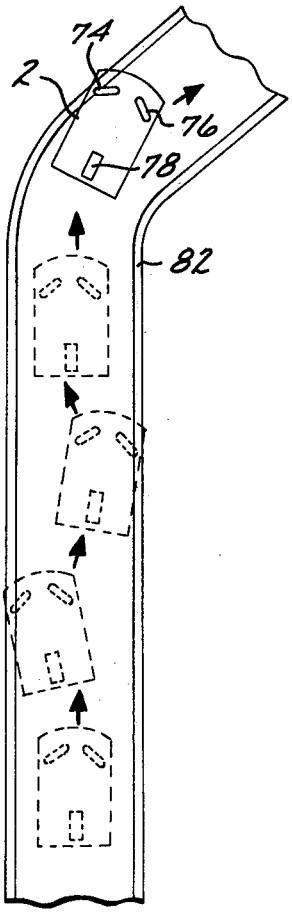
FIG. 8 is a schematic view of the interaction of the toy vehicle and a pair of guidelines.

As can be seen in FIG. 8, the effect of the front wheels 74 and 76 is to drive the vehicle 2 inward within the pair of tracks to maintain the vehicle along the designated path when it has been inserted between the two tracks. Thus, the second embodiment discloses a modification resulting from a different inclination of the front wheels and the use of a pair of guide tracks as opposed to the single guide track that is positioned between the two front wheels in the first embodiment shown in FIGS. 3 and 4. The basic principles of the invention, however, are maintained in that the coefficient of friction of the drive wheel is greater than the respective coefficients of friction of the front wheels so that the drive wheel can propel the toy vehicle with a force directed along its longitudinal axis irregardless of the support surface coefficient of friction while each of the front wheels will laterally slip on the support surface and will alternatively drive the toy vehicle when they contact the guide pattern portion of the support surface having a greater coefficient of friction. Again, the respective axis of rotation of each of the wheels are non-parallel.

As can be appreciated, the drive members can be other than wheels, for example a belted track assembly could be utilized and, of course, the drive wheel could be a front wheel while a pair of rear wheels can actually provide the steering function.

A child can be provided with the toy assembly of the present invention in the form of a kit. The kit would include a vehicle having a pair of control wheels of a low coefficient of friction and a drive wheel of a high coefficient of friction. The axis of the wheels will be non-parallel. The toy assembly will further include a support surface. The particular support surface can be a sheet of a flexible plastic that is receptive to receiving a frictional indicia guide path drawn by the child as shown in FIG. 1. Alternatively, the support surface can be a fixed plastic or other material substrate wherein a permanent frictional guide path is provided on the substrate. As can be appreciated, either a single indicia guide path or a pair of indicia guide paths can be provided and the orientation of the control wheels of the vehicle would accordingly be adjusted.

The method by which the child can play with the toy assembly is to assemble or spread out the support surface having a coefficient of friction of such a value that the control wheels slide across the support surface while the drive wheels of a higher coefficient of friction will drive the toy vehicle. The child can provide an indicia pattern on the support surface that has a coefficient of friction greater than the support surface and of such a relative value to that of the control wheels that they will drive the toy vehicle upon contact. The specific indicia guide pattern that is provided by the child would be such that only one of the control wheels will contact it at any time during a desired controlled movement of the vehicle. Finally, the toy vehicle would be positioned on the support surface relative to the indicia guide pattern so that the control wheels are operatively positioned to be responsive to the guide pattern to control the locomotion of the toy vehicle.

Other modifications of the present invention are possible and accordingly, the scope of the present invention should not be limited by the specific embodiments disclosed herein and should be measured solely from the following claims wherein I claim:

What is claimed is:

1. A vehicle capable of locomotion and more particularly controlled locomotion in response to variations in frictional resistances along a support surface, comprising;

a base member;

a first driving member assembly operatively connected to the base member for rotation about a first axis, and a second pair of driving members operatively connected to the base member and rotating respectively about a second and third axis that are each nonparallel to the first axis of the first driving member, whereby the first driving member can propel the vehicle and the second pair of driving members can principally control the direction of movement in response to variations in frictional resistance along the surface that contacts one of the second pair of driving members.

2. The invention of claim 1 wherein the first driving member assembly includes a wheel having a higher coefficient of friction than the second pair of driving members.

3. The invention of claim 2 wherein the second pair of driving members are front wheels on the base member and the first driving wheel is a rear wheel on the base member.

4. The invention of claim 3 wherein all of the wheel axes are respectively non-parallel.

5. The invention of claim 3 wherein the second pair of driving members are rotatively mounted on the base member so that their respective second and third axis diverge away from the first rear wheel.

6. The invention of claim 4 wherein the first driving member assembly includes a powered motor and transmission means for providing a driving connection with each wheel and the powered motor.

7. The invention of claim 6 wherein the transmission means includes a pair of flexible cables for respectively driving each of the front wheels.

8. The invention of claim 4 wherein the second pair of drive front wheels are made from a thermoplastic polyamide having a low coefficient of friction characteristic.

9. A toy assembly for subjectively controlling the locomotion of a driven toy comprising;

a support surface;

means for subjectively marking the support surface to provide indicia of a higher coefficient of friction than the support surface; and a toy having a first driving member and a second pair of driving members, the coefficient of friction of the second pair of driving members has a value relative to the coefficient of friction of the support surface and the indicia such that they can slide across the support surface but will engage the indicia whereby the second pair of driving members can control the direction of the toy.

10. The invention of claim 9 wherein the first driving member has a higher coefficient of friction than the second pair of driving members.

11. The invention of claim 10 further including means for removing the indicia from the support surface to permit subsequent remarking with a different indicia pattern.

12. The invention of claim 10 wherein the support surface is a flexible plastic sheet.

13. The invention of claim 10 wherein each of the driving members rotate about an axis of rotation and all of the axes are respectively non-parallel.

14. The invention of claim 13 wherein the first driving member lies in a first longitudinal plane of the toy and the respective second pair of driving members lie in a second and third plane that intersect the first plane.

15. The invention of claim 10 wherein the second pair of driving members are front wheels on the toy and the first driving member is a rear wheel on the toy.

16. The invention of claim 15 wherein the second pair of drive front wheels are made from a thermoplastic polyamide and the rear wheel is made from a material having a coefficient of friction approximately that of natural rubber.

17. The invention of claim 11 wherein the means for removing the indicia includes water and an applicator for contacting the support surface.

18. The invention of claim 9 wherein the means for subjectively marking includes a hand held marker.

19. The invention of claim 9 wherein the means for subjectively marking includes a removable tape capable of adhering to the support surface.

20. The invention of claim 9 wherein the means for subjectively marking includes forming an irregular surface pattern on the support surface.

21. The invention of claim 18 wherein the hand held marker is a crayon.

22. A toy vehicle capable of controlled locomotion in response to variations in frictional resistance along a support surface having at least two different coefficients of friction, one coefficient of friction existing on a predetermined guide pattern comprising;

a base member having a longitudinal axis;

a first wheel operatively connected to the base member for rotation about a first axis traverse to the longitudinal axis;

a second pair of wheels operatively connected to the base member and rotating respectively about a second and third axis that are each non-parallel to the first axis and also to each other;

means for driving each wheel, whereby the first wheel can propel the toy vehicle with a force directed along the longitudinal axis regardless of the support surface coefficient of friction while each of the second pair of wheels will laterally slip on at least one portion of the support surface and will drive the toy vehicle when contacting the guide pattern portion of the support surface having a greater coefficient of friction.

23. The invention of claim 22 wherein the means for driving each wheel includes a gear train and a pair of flexible cable members for respectively driving each of the second pair of wheels.

24. The invention of claim 22 further including a shell housing subjectively configured to represent a vehicle connected to the base member.

25. The invention of claim 23 further including means for mounting the pair of flexible cable members on the base member.

26. A method of controlling the locomotion of a toy vehicle having a first rotatable wheel and a second pair of rotatable wheels, the respective axis of rotation of each wheel is non-parallel to each of the other wheels comprising the steps of;

(a) providing a support surface having a coefficient of friction of such a value that the second wheels will slide across the support surface while the first wheel will drive the toy vehicle;

(b) providing an indicia pattern on the support surface having a coefficient of friction greater than the support surface and of such a relative value to that of the second wheels that they will drive the toy vehicle upon contact, the indicia pattern having such a configuration that only one of the second wheels will contact it at any time during a desired controlled movement, and (c) positioning the toy vehicle on the support surface relative to the indicia pattern so that the second wheels are operatively positioned to be responsive to the indicia pattern to control the locomotion of the toy vehicle.

27. The invention of claim 26 further including the step of removing the indicia pattern and repeating steps (a), (b) and (c) with a different indicia pattern.

28. The invention of claim 26 wherein the step of providing an indicia pattern includes drawing a continuous line on the support surface.

29. The invention of claim 26 wherein the step of providing an indicia pattern includes depositing a water soluble material on the surface of the support surface.

30. The invention of claim 26 wherein the step of providing an indicia pattern includes embossing a serrated pattern on the support surface.

31. A toy vehicle capable of controlled locomotion in response to variations in frictional resistance along a support surface having at least two different coefficients of friction, one coefficient of friction existing on a predetermined guide pattern comprising;

a base member having a longitudinal axis;

a first wheel operatively connected to the base member for rotation about a first axis traverse to the longitudinal axis;

a second pair of wheels operatively connected to the base member and rotating respectively about a second and third axis that are each nonparallel to the first axis and also to each other; and means for continuously driving each of the wheels during locomotion of the vehicle, the coefficient of friction of the second pair of wheels having a value relative to the coefficient of friction of the support surface and the guide pattern such that they can slide across the support surface but will individually engage the guide pattern to provide a force to control the vehicle locomotion, whereby the first wheel can propel the toy vehicle with a force directed along the longitudinal axis regardless of the support surface coefficient of friction while each of the second pair of wheels will laterally slip on at least one portion of the support surface and will drive the toy vehicle when contacting the guide pattern portion of the support surface having a greater coefficient of friction.

* * * * *